US006193308B1

(12) United States Patent
Hwang

(10) Patent No.: US 6,193,308 B1
(45) Date of Patent: Feb. 27, 2001

(54) COLLAPSIBLE CHAIR HAVING A TABLE

(76) Inventor: Joo-Hwan Hwang, #Ga-401, HyunDae Green Villa, 14 block, 24-8 Schinchun-Dong,Sihwen-City, Kyunggi-Do (KR)

( * ) Notice: Subject to any disclaimer, the term of this patent is extended or adjusted under 35 U.S.C. 154(b) by 0 days.

(21) Appl. No.: 09/368,329

(22) Filed: Aug. 3, 1999

(30) Foreign Application Priority Data

Feb. 5, 1999 (KR) ..... 99-4055

(51) Int. Cl.[7] ..... A47B 39/00
(52) U.S. Cl. ..... 297/171; 45/188.2; 45/248
(58) Field of Search ..... 297/16.2, 16.1, 297/248, 160, 171, 173, 170, 188.2, 35, 42, 45, 59, 188.01, 440.11, 440.1, 440.22, 440.2, 440.21, 162

(56) References Cited

U.S. PATENT DOCUMENTS

| | | | | |
|---|---|---|---|---|
| 506,085 | * | 10/1893 | Whelan | 297/160 |
| 1,663,781 | * | 3/1928 | Spargo | 297/170 |
| 2,023,173 | * | 12/1935 | Hiener | 297/188.2 X |
| 2,710,051 | * | 6/1955 | Greenberg | 297/170 X |
| 3,025,103 | * | 3/1962 | Mohror | 297/171 |
| 3,125,372 | * | 3/1964 | Rose | 297/188.2 |
| 3,174,795 | * | 3/1965 | Chapman et al. | 297/160 |
| 4,300,798 | * | 11/1981 | Musgrove et al. | 297/162 X |
| 5,356,061 | * | 10/1994 | Yu | 224/275 |
| 5,597,139 | * | 1/1997 | Beroth | 297/248 X |
| 5,765,909 | * | 6/1998 | Catriner | 297/173 X |
| 5,820,210 | * | 10/1998 | Shipman et al. | 297/188.2 X |
| 5,984,406 | * | 11/1999 | Lee | 297/16.2 |

FOREIGN PATENT DOCUMENTS

| | | | | |
|---|---|---|---|---|
| 177232 | * | 6/1953 | (AT) | 297/173 |
| 68468 | * | 5/1893 | (DE) | 297/170 |
| 2489122 | * | 3/1982 | (FR) | 297/248 |
| 454067 | * | 1/1950 | (IT) | 297/170 |

* cited by examiner

*Primary Examiner*—Milton Nelson, Jr.
(74) *Attorney, Agent, or Firm*—Nawrocki, Rooney & Sivertson, P.A.

(57) ABSTRACT

A collapsible chair with a table is disclosed. In the collapsible chair, two collapsible chair units are arranged abreast on the chair with a gap being defined between them. A rear vertical guide column extends in parallel to the inside back support column of each collapsible chair unit. The two collapsible chair units are coupled to each other into the collapsible single body by two auxiliary connectors, which are individually mounted to the top portion of both the inside back support column and an associated vertical guide column of each collapsible chair unit. A movable guide member is received in each guide column in a way such that the guide member is movable in a vertical direction under the guide of the guide column. The table is movably coupled to the outside end of the guide members of the two collapsible chair units, thus being rotatable around the two guide members forwardly or backwardly. Two front vertical columns are individually provided at the inside corner of the front portion of each collapsible chair unit, thus supporting the front portion of the table in a horizontal position. An extension is provided at each auxiliary connector so as to allow the two auxiliary connectors to have the same height as that of the two front vertical columns. The two extensions thus support the rear portion of the table in the horizontal position.

5 Claims, 12 Drawing Sheets

COLLAPSIBLE CHAIR HAVING A TABLE

BACKGROUND OF THE INVENTION

1. Field of the Invention

The present invention relates, in general, to a collapsible chair with a table and, more particularly, to a collapsible chair having a table and designed to be selectively used as a chair, a leisure table with chairs, or an indoor simple table with chairs, thereby being conveniently used for a variety of purposes, the collapsible chair, with the table, also being designed to be convenient to users while carrying or storing it, and requiring only a small area while being used or stored.

2. Description of the Prior Art

A collapsible chair, comprising a plurality of legs, or front, rear, left and right legs, has been proposed and used. In the conventional collapsible chair, the front, rear, left, or right legs cross each other into a front, rear, left or right X-shaped collapsible leg frame. The above leg frames are also coupled to each other at their upper and lower ends using a plurality of front and rear supports and a plurality of front and rear connectors, thus forming a collapsible chair framework. Two back support columns are mounted to the two rear support and the two rear connectors provided at the rear leg frame and supports a back support member. In addition, a seat member is supported by the four connectors of the collapsible framework.

While designing such conventional collapsible chairs, the most important objective is to allow a chair to be easily foldable, thereby being easily and conveniently carried by users and being effectively stored within a limited area. Several types of collapsible chairs, individually having a structure capable of accomplishing the above-mentioned objective, have been proposed and used.

However, such conventional collapsible chairs are problematic in that they are designed to be only used as collapsible and portable chairs, thus being limited in their use.

When it is necessary to use such a collapsible chair with a table, a user has to purchase and carry a separate table in addition to the collapsible chair. This is inconvenient to the user while carrying or storing the table along with the collapsible chair.

In an effort to overcome such a problem experienced in the conventional collapsible chairs, a collapsible leisure table, made of a plastic material and integrated with a plurality of collapsible plastic chairs, has been proposed and somewhat widely used. However, such a collapsible leisure table is problematic in that it is very difficult to carry the table because the table is very heavy and has a large size and volume even when the table is fully collapsed. Due to the large size and volume of the fully collapsed table, it is also difficult to store the table within a limited area. Another problem, experienced in the above collapsible leisure table, resides in that the table is somewhat expensive, thus failing to be generally used.

SUMMARY OF THE INVENTION

Accordingly, the present invention has been made keeping in mind the above problems occurring in the prior art, and an object of the present invention is to provide a collapsible chair, which has a table and is designed to be selectively used as a chair, a leisure table with chairs, or an indoor simple table with chairs, thereby being conveniently used for a variety of purposes.

Another object of the present invention is to provide a collapsible chair, which has a table and is designed to be easily collapsible, thus being convenient to users while carrying or storing it, and requiring only a small area while being used or stored.

In order to accomplish the above objects, the present invention provides a collapsible chair, comprising: two or more collapsible chair units arranged abreast on the chair with a gap being defined between the chair units; a rear vertical guide column positioned in the back of the inside back support column of each collapsible chair unit while extending in parallel to the back support column, the guide column being fixed to the inside one of two rear supports, with the collapsible chair units being coupled to each other into the collapsible single body by two auxiliary connectors, the two auxiliary connectors being individually mounted to the top portion of both the inside back support column and an associated vertical guide column of each of the collapsible chair units; a movable guide member received in each of the guide columns in a way such that the guide member is movable in a vertical direction under the guide of the guide column, with a table being movably coupled to the outside end of the guide members of two collapsible chair units in a way such that the table is rotatable around the two guide members forwardly or backwardly; two front vertical columns individually provided at the inside corner of the front portion of each collapsible chair unit, thus supporting the front portion of the table when the table is positioned horizontally; and an extension provided at each of the two auxiliary connectors so as to allow the two auxiliary connectors to have the same height as that of the two front vertical columns, thus supporting the rear portion of the table when the table is positioned horizontally.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
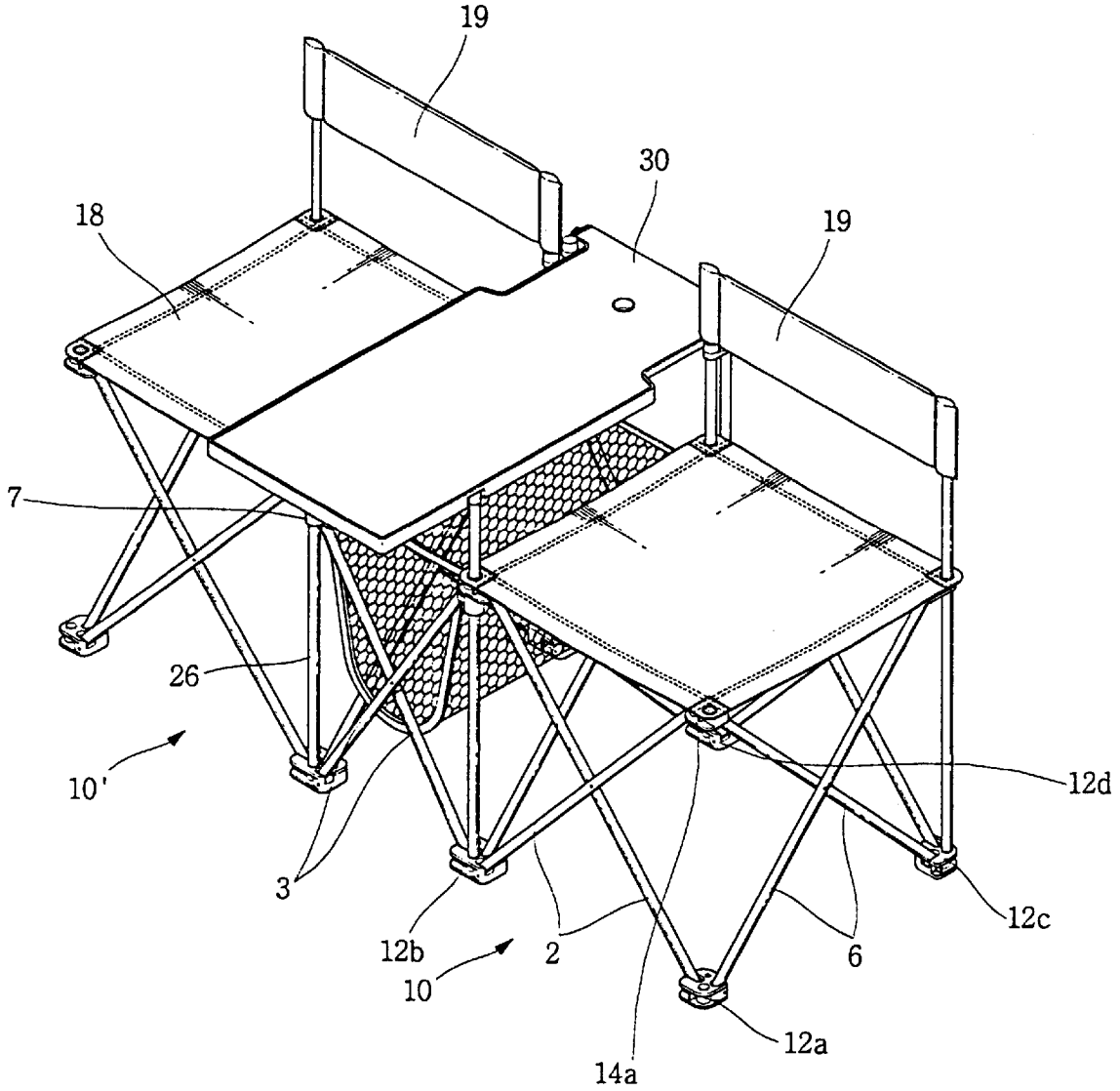
FIG. 1 is a perspective view of a collapsible chair with table in accordance with the primary embodiment of the present invention, when the chair and table are fully expanded.
Figure 2:
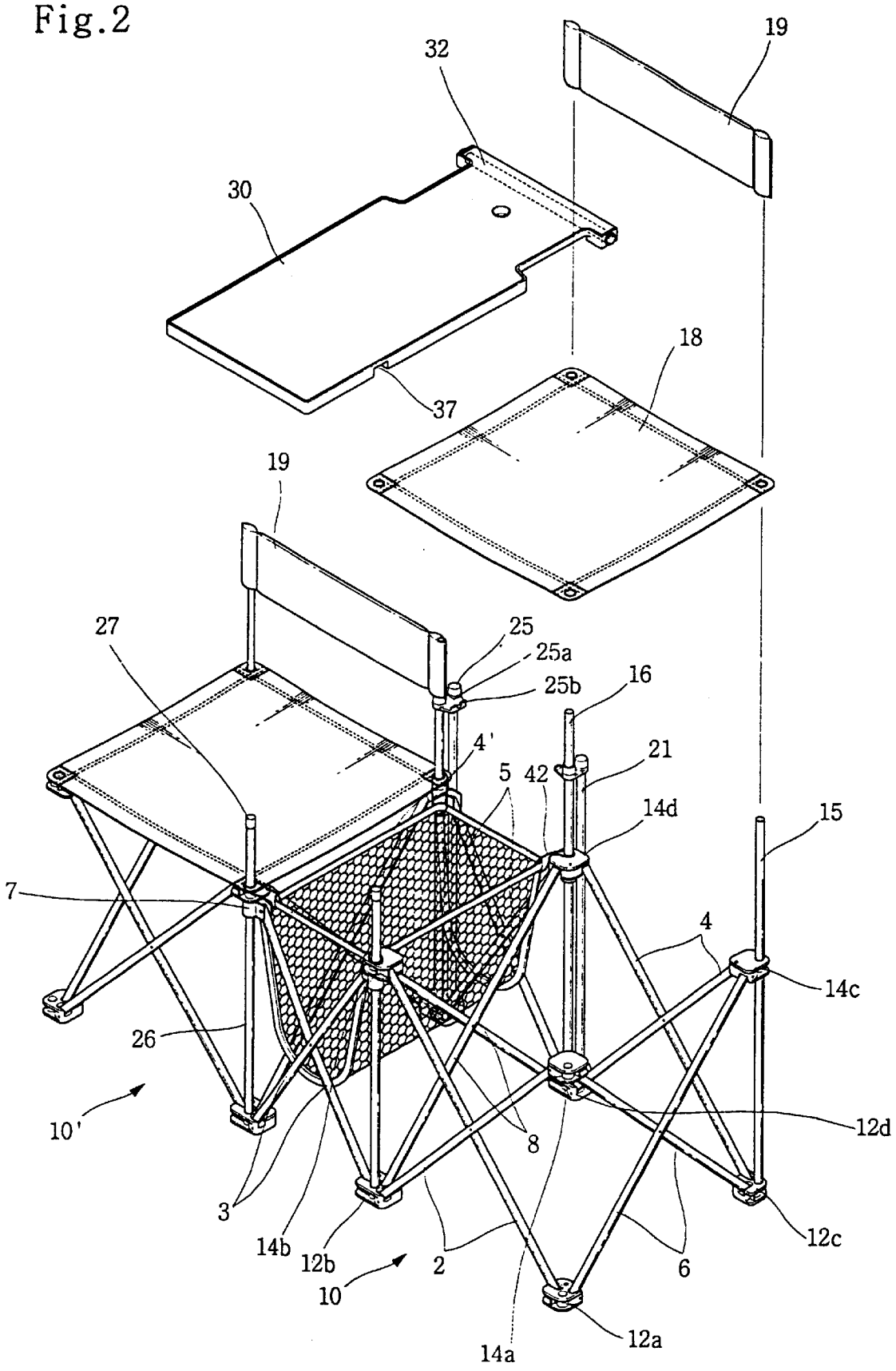
FIG. 2 is an exploded perspective view, showing the construction of the collapsible chair with the table in accordance with the invention.
Figure 3:
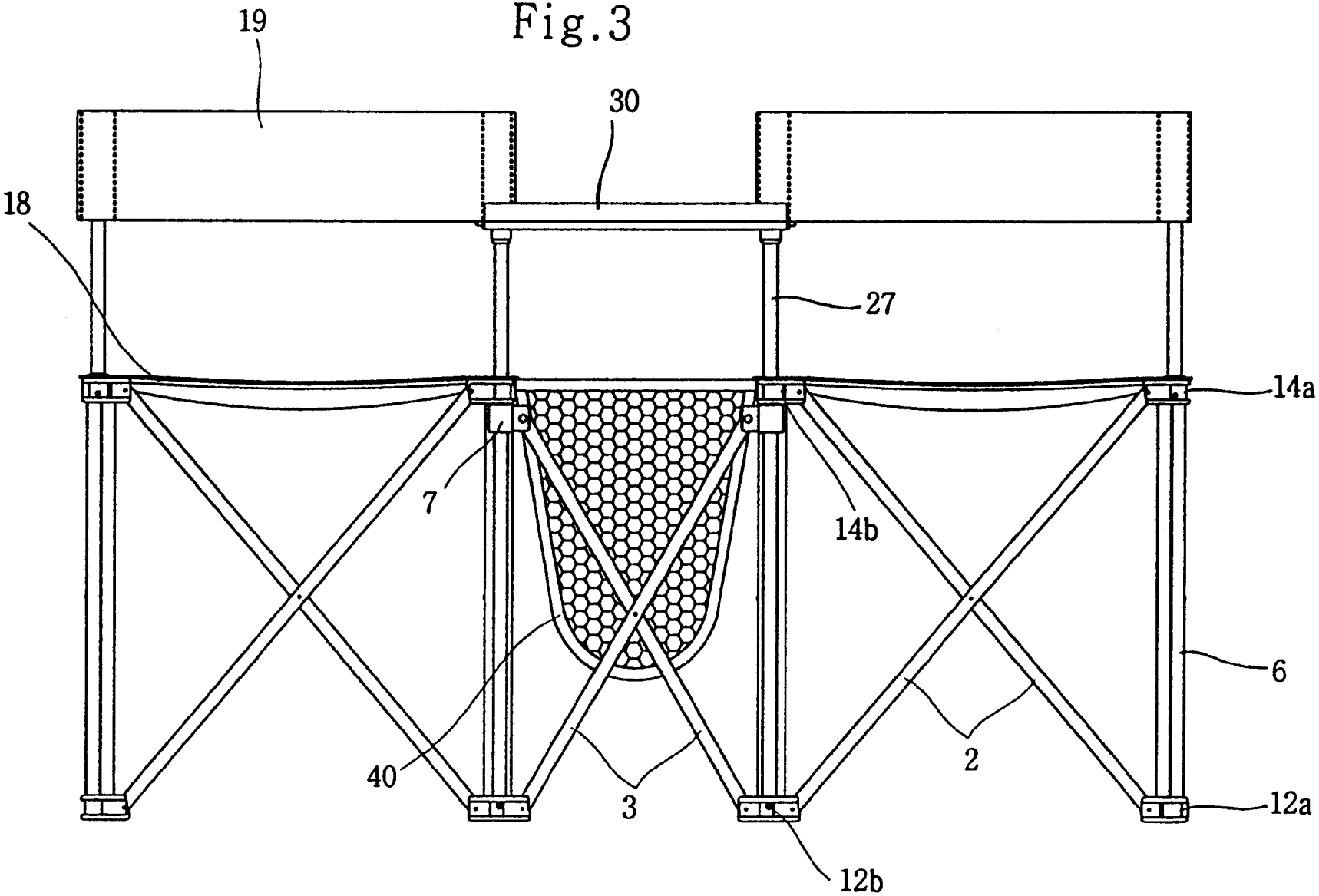
FIG. 3 is a front view of the collapsible chair with the table in accordance with the invention.
Figure 4:
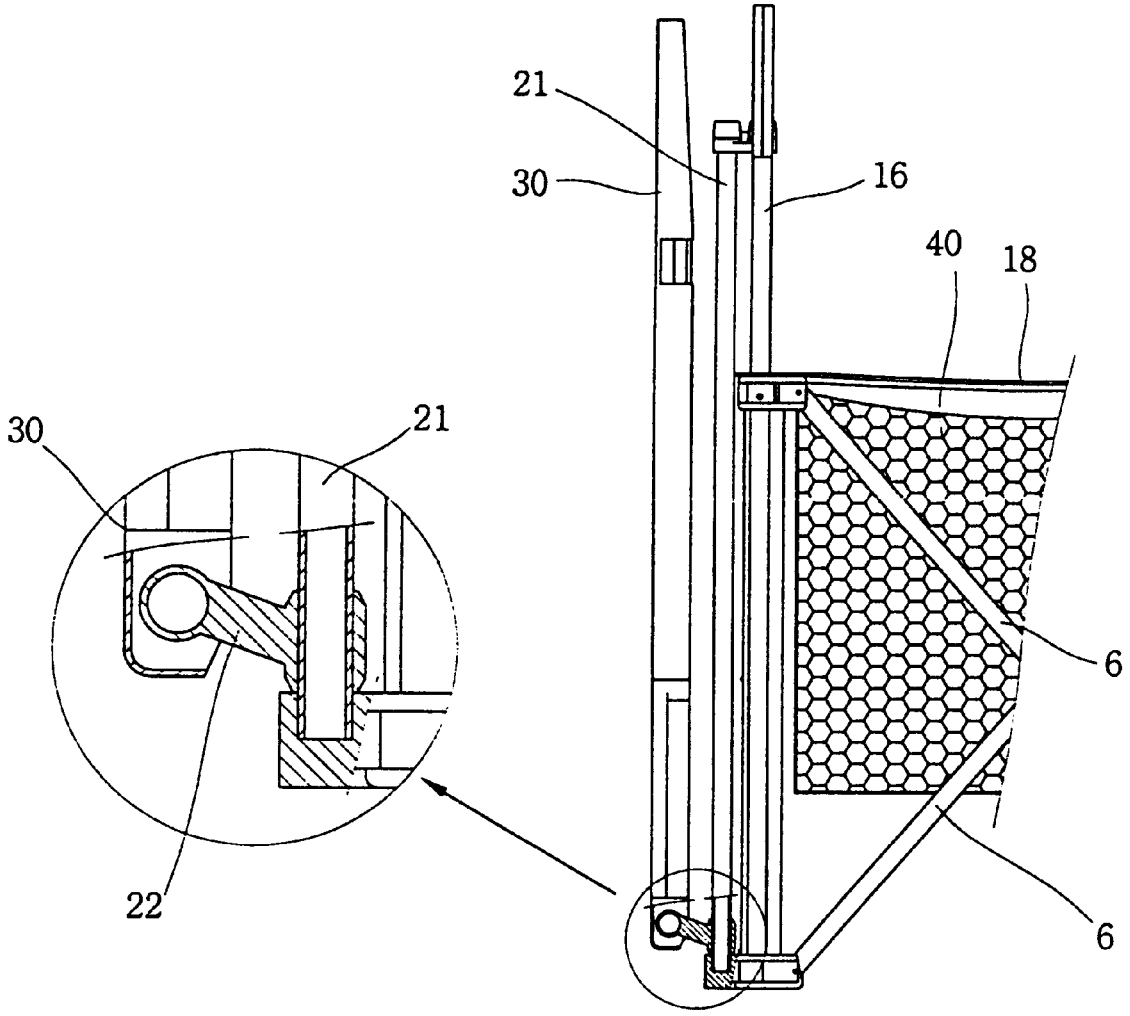
FIG. 4 is a view, showing a movable engagement of a guide member with a horizontal bar of the table according to the invention.
Figure 5:
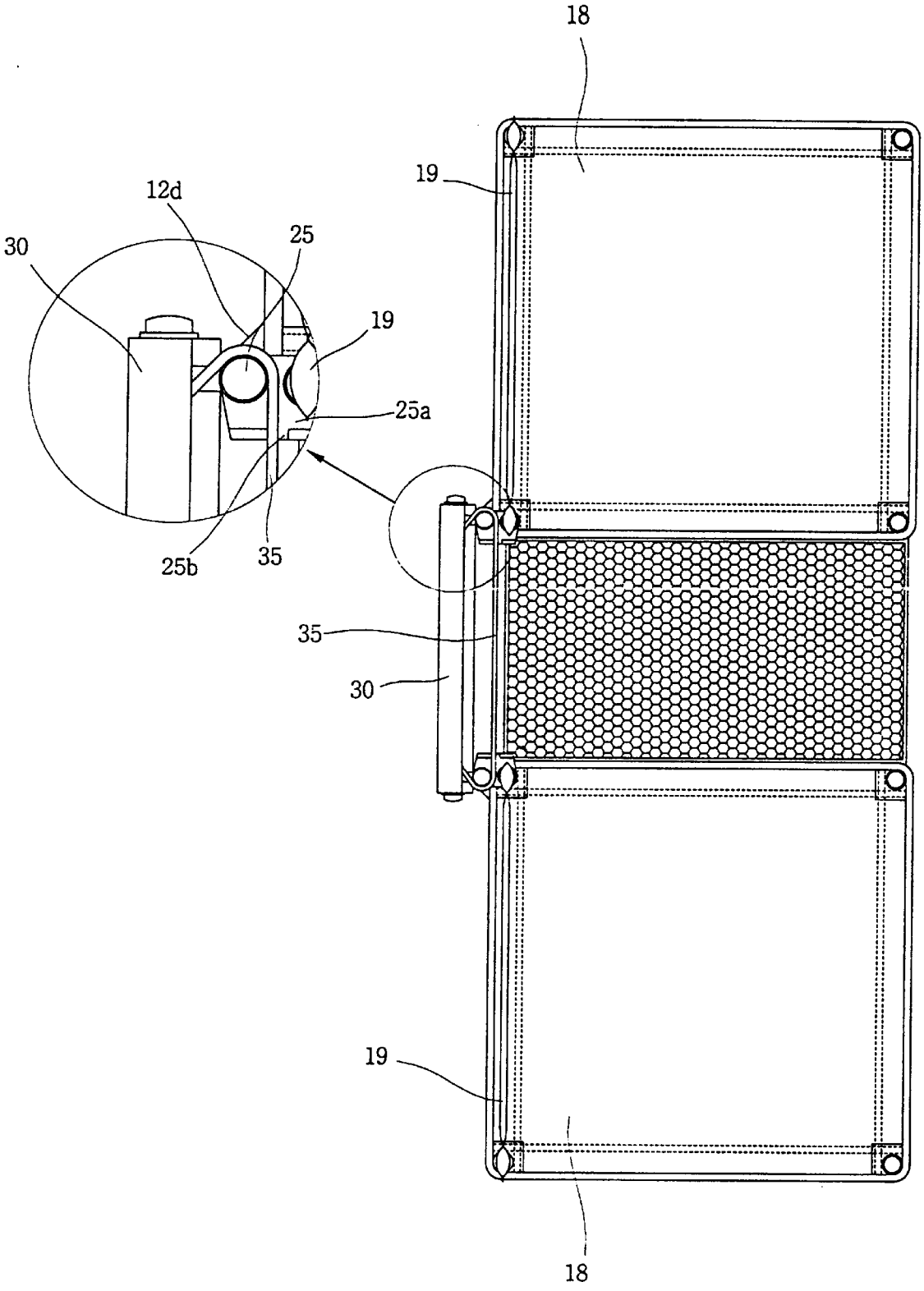
FIG. 5 is a view, showing an engagement of a support wire of the table with an auxiliary connector according to the invention.
Figure 6:
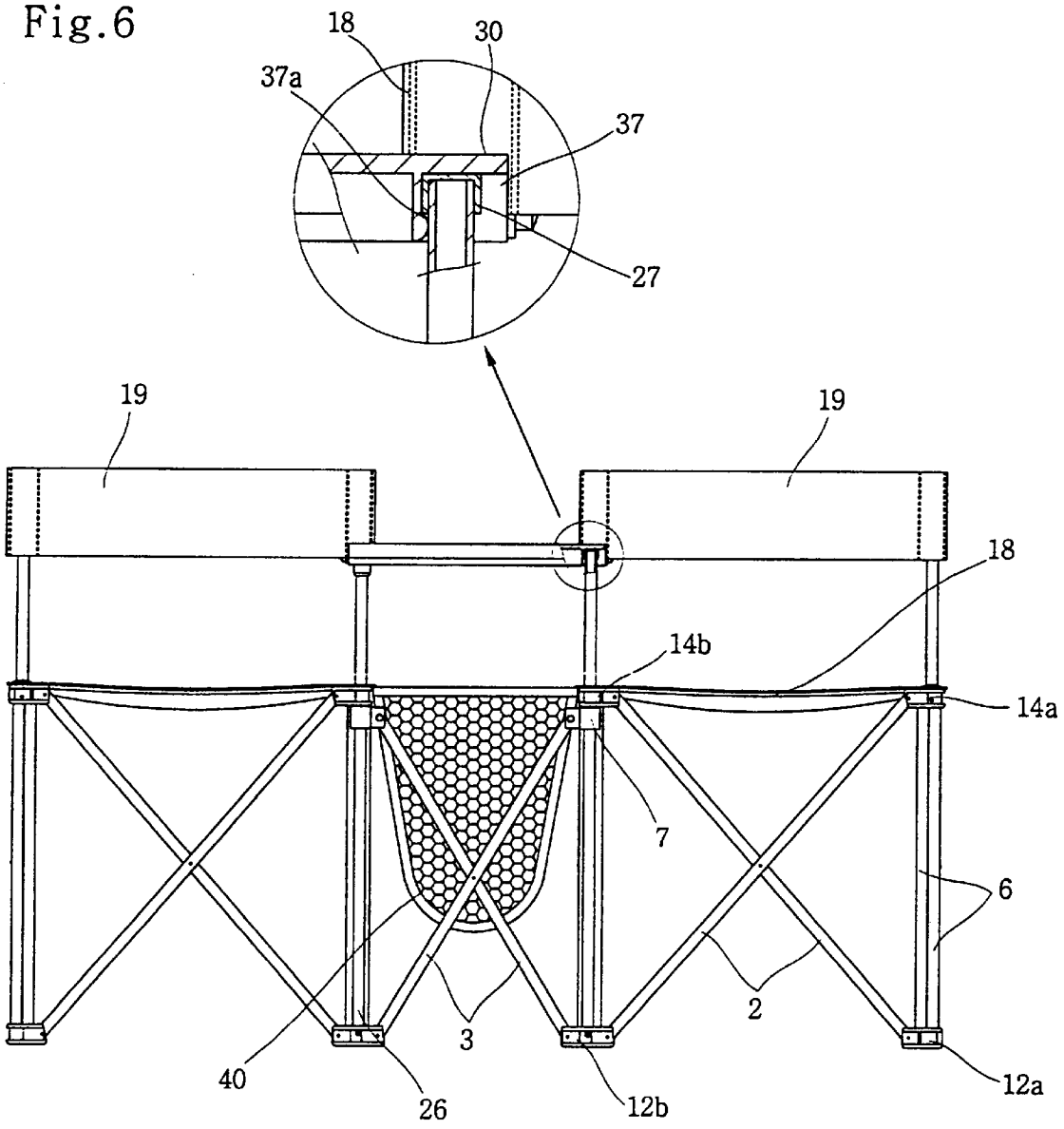
FIG. 6 is a view, showing an engagement of a locking slot of the table with a locking cap according to the invention.
Figure 7A:
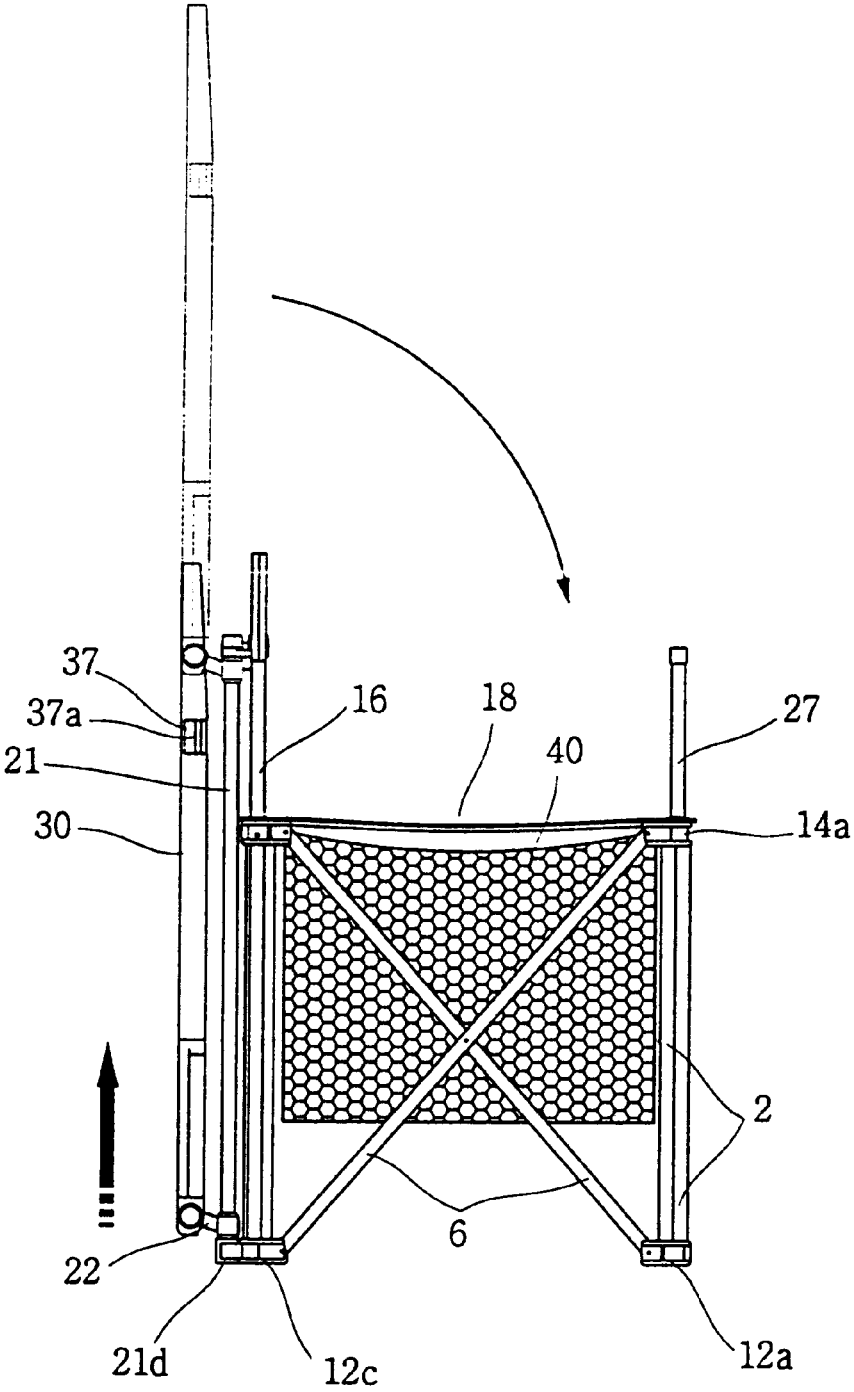
FIGS. 7*a* and 7*b* are side views, showing an operation of the table according to the invention when the table is moved from a vertical closed position to a horizontal position, or a usable position.
Figure 7B:
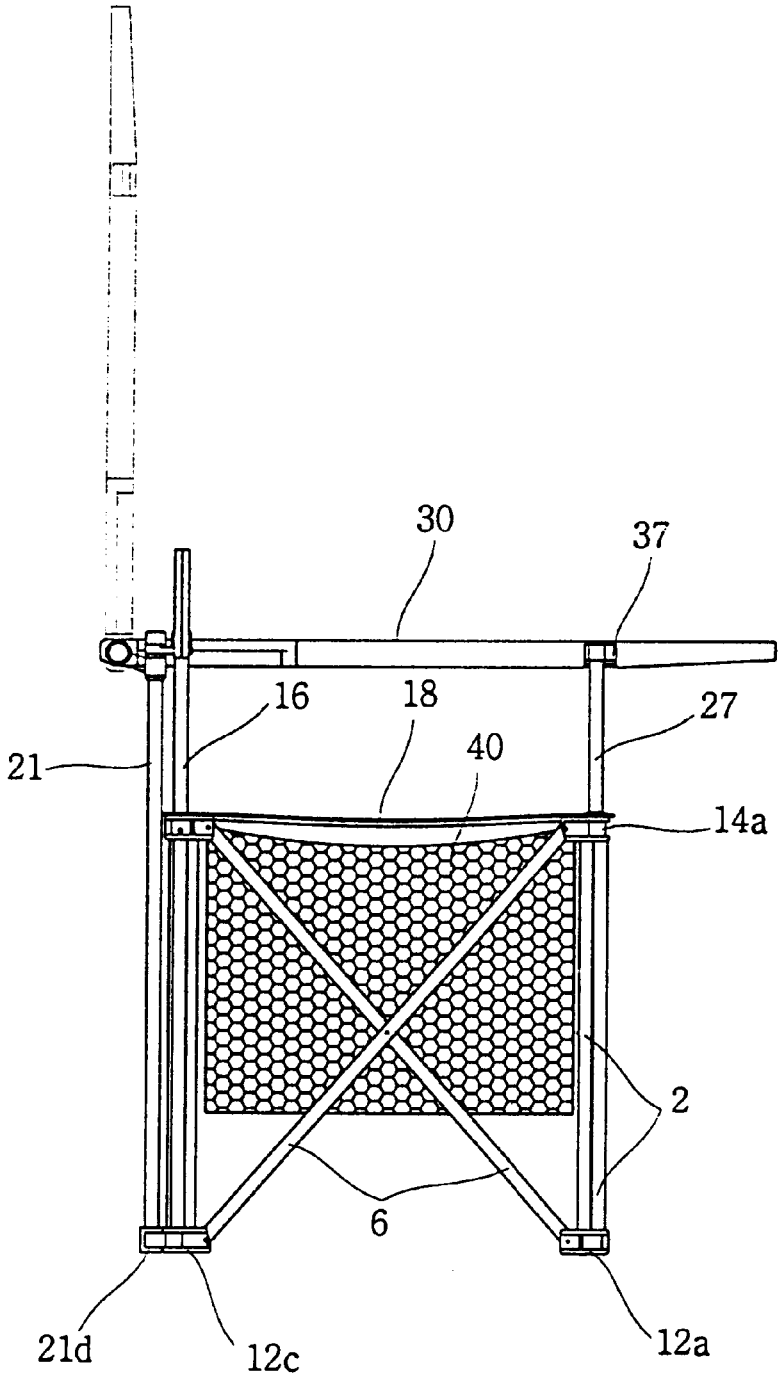

FIGS. 1 to 6 show a collapsible chair with a table in accordance with the primary embodiment of the present invention. As shown in the drawings, two collapsible chair units 10 and 10' are provided at both sides of the collapsible chair of this invention and are integrated with each other into a collapsible single body. Each of the two chair units comprises a plurality of legs, or two front, two rear, two left and two right legs 2, 4, 6 and 8. In the collapsible chair, the two front, rear, left, or right legs 2, 4, 6, 8 cross each other into a front, rear, left or right X-shaped collapsible leg frame. The above leg frames are also coupled to each other at their upper and lower ends using a plurality of front and rear supports 12*a*, 12*b*, 12*c* and 12*d* and a plurality of front and rear connectors 14*a*, 14*b*, 14*c* and 14*d*, thus forming a collapsible chair framework. Two back support columns, or first and second back support columns 15 and 16 are held by the two rear supports 12*c* and 12*d* and the two rear connectors 14*c* and 14*d* which are provided at the rear leg frame and supports a back support member 19 thereon. In addition, a seat member 18 is supported by the four connectors 14*a*, 14*b*, 14*c* and 14*d* of the collapsible chair framework.

In the above chair, the two collapsible chair units 10 and 10' are arranged at both sides of the chair while being spaced apart from each other by a distance and are integrated with each other into a collapsible single body using two collapsible X-shaped intermediate frames 3 and 5.

In order to assemble the two collapsible chair units 10 and 10' into a collapsible single body, a rear vertical guide column 21 is positioned in the back of the second back support column 16 of each chair unit 10, 10'. The above guide column 21 extends in parallel to the column 16. The above guide column 21 is fixed to the rear support 12*d* of the rear leg frame. The two chair units 10 and 10' are coupled to each other by two auxiliary connectors 25 which are individually mounted to the top portion of each back support column 16 and an associated vertical guide column 21.

A movable guide member 22 is received in each of the guide columns 21 in a way such that the guide member 22 is movable in a vertical direction under the guide of the guide column 21. A table 30 is movably coupled to the outside end of the two guide members 22 in a way such that the table 30 is rotatable around the two guide members 22 forwardly or backwardly.

The two auxiliary connectors 25 individually have an extension 25*a*. Due to the extensions 25*a*, the two auxiliary connectors 25 have the same height as that of two front vertical columns 26. The two front vertical columns 26 are individually provided at the inside corner of the front portion of each collapsible chair unit 10, 10'. Therefore, the two extensions 25*a* of the auxiliary connectors 25 and the two front vertical columns 26 support the four corners of the table 30 horizontally.

The table 30 has a horizontal bar 32, of which both ends meet the two guide columns 21 at right angles. The two guide members 22 are brought into slidable engagement with the horizontal bar 32 of the table 30 in a way such that the guide members 22 are movable in opposite directions along the horizontal bar 32 when the collapsible chair is opened or closed.

An elastic support wire 35 is horizontally provided on the rear edge of the table 30. When the table 30 is fully collapsed into a vertical position, the above support wire 35 is locked to the locking holes 25*b* formed at the two auxiliary connectors 25, thus holding the table 30 in the vertical position without allowing the table 30 to be movable.

A locking cap 27 is fitted over the top end of each front vertical column 26, while the table 30 has a locking slot 37 at each side edge thereof at a position corresponding to each of the caps 27. Therefore, when the front portion of the table 30 is horizontally held on the two front vertical columns 26, the two locking caps 27 are fitted into the two locking slots 37, thus stably supporting the front portion of the table 30 in the horizontal position.

A net bag 40, which is opened at the top, is provided at the gap defined between the two collapsible chair units 10 and 10'. The above net bag 40 has four hook rings 42 at the four corners of its top edge. Of the four hook rings 42, two front rings 42 are removably caught by the two front vertical columns 26, while the two rear rings 42 are removably caught by the two second back support columns 16, thus being removably attached to the collapsible chair of this invention.

Figure 10:
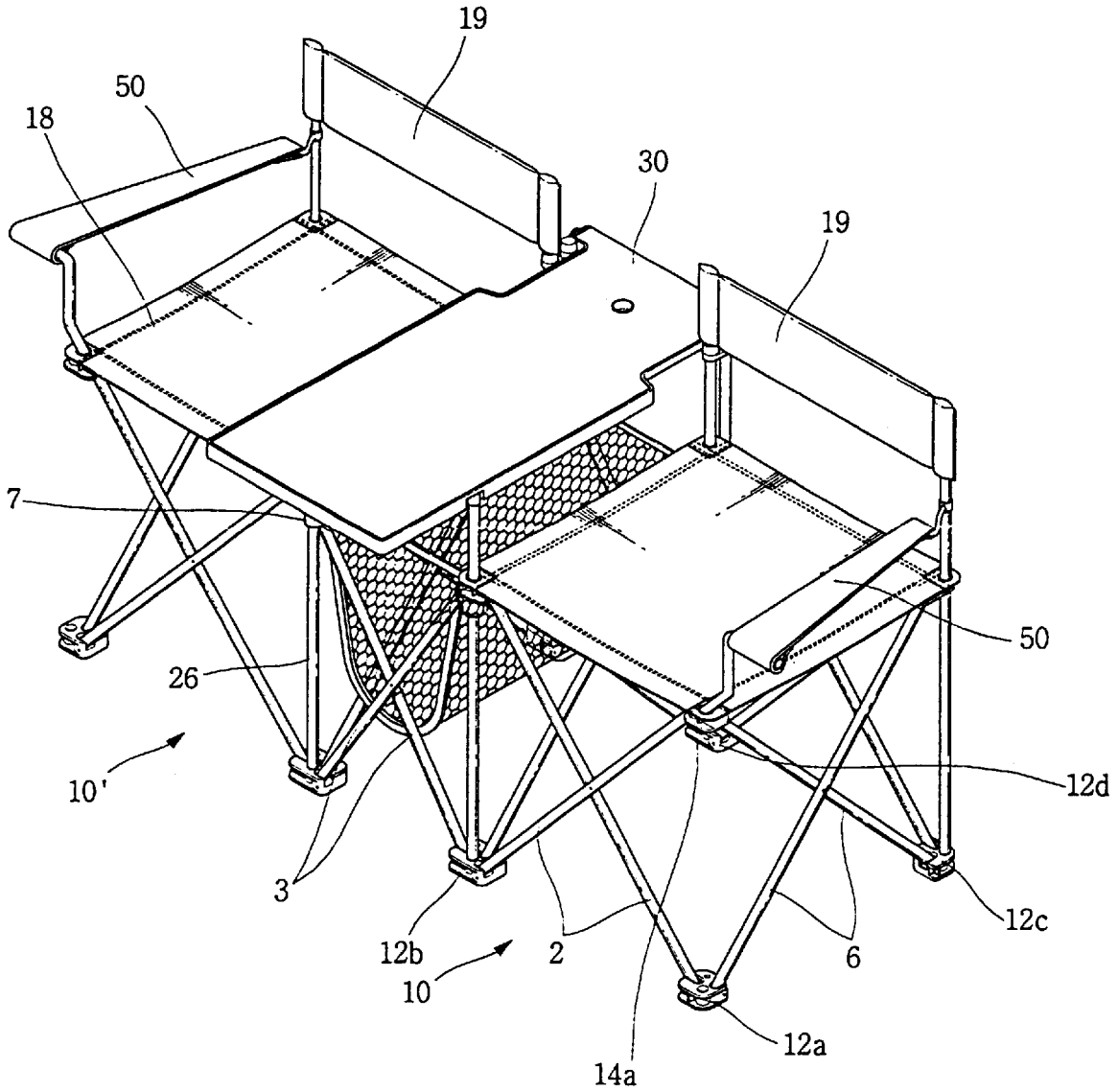
FIG. 10 is a perspective view of a collapsible chair with a table in accordance with the second embodiment of the present invention, with the chair and table being fully expanded.

As shown in FIG. 10, showing another embodiment of this invention, an arm rest 50 may be attached to the outside portion of each chair unit 10, 10'.

In the drawings, the reference numeral 7 denotes an auxiliary coupling member which is provided at each of the two front vertical columns 26 and the two back support columns 16. The four auxiliary coupling members 7 are used for hinging the two X-shaped collapsible intermediate leg frames 3 and 5 to the supports 12*b* and 12*d* of the two chair units 10 and 10', respectively.

The operational effect of the above collapsible chair with the table will be described hereinbelow.

In order to move the table 30 from a vertical closed position to a horizontal position, or a usable position, the two guide members 22, slidably assembled with the horizontal bar 32 of the table 30, are moved upwardly along the two guide columns 21 until the two guide members 22 come into contact with the two auxiliary connectors 25.

In such a case, the table 30 is moved upwardly along with the guide members 22.

After the table 30 is completely moved upwardly along with the guide members 22, the horizontal bar 32 is rotated forwardly around the two guide members 22, thus being rotated forward and being positioned horizontally.

When the table 30 is positioned horizontally as described above, the two rear corners of the table 30 are supported by the extensions 25*a* of the two auxiliary connectors 25, while the opposite edges of the front portion of the above table 30 are held on the top ends of the two front vertical columns 26. Since the height of the two extensions 25*a* is equal to that of the two front vertical columns 26, the table 30 accomplishes a desired horizontality.

In such a case, the locking cap 27, fitted over the top end of each front vertical column 26, is fitted into an associated locking slot 37 formed on the front portion of the table 30. Therefore, the table 30 is stably held on the two front vertical columns 26 while being almost completely prevented from being undesirably moved to the front, back, left or right.

As described above, the table 30 is horizontally placed at the gap between the two collapsible chair units 10 and 10'. The collapsible chair, with the horizontally positioned table 30, may be used for a variety of purposes.

When it is necessary to use the collapsible chair with the table 30 being fully closed, the table 30 is moved from the above-mentioned horizontal position to the vertical position. In order to move the table 30 from the horizontal position to the vertical position, the two locking caps 27 of the front vertical columns 26 are forcibly and manually opened to be moved away from each other, thus releasing the two locking slots 37 of the table 30 from the caps 27.

The horizontal bar 32 of the table 30 is rotated backwardly around the two guide members 22, thus allowing the table 30 to have a vertical position.

The table 30 in the vertical position is, thereafter, moved downwardly. In order to move the vertically positioned table 30 downwardly, the two guide members 22, engaging with the horizontal bar 32, are moved downwardly along the two guide columns 21 until the table 30 is fully closed.

When the table 30 is fully moved downwardly, the elastic support wire 35 of the table 30 is guided by the locking holes 25*b* of the two auxiliary connectors 25, thus being brought into engagement with the two auxiliary connectors 25.

The above table 30 is thus held by the two guide members 22 at the horizontal bar 32 and is held by the auxiliary connectors 25 at the support wire 35. Therefore, the table 30 in the vertical closed position is stably held without being undesirably moved to the front or back.

When the two collapsible chair units 10 and 10' are fully opened with the table 30 being fully closed as described above, the collapsible chair of this invention is used as a double chair without having a table.

In addition, the net bag 40, opened at the top, is provided at the gap defined between the two chair units 10 and 10'. The above net bag 40 has four hook rings 42 at the four corners of its top edge and is removably held by both the front vertical columns 26 and the back support columns 16 at the four hook rings 42. The above net bag 40 may be preferably used as a garbage bag or a container capable of receiving food or a variety of necessaries therein when the chair is used outdoors.

When the arm rest 50 is attached to the outside portion of each chair unit 10, 10' as shown in FIG. 10, the chair of this invention may be more convenient to users.

When it is necessary to fully fold the collapsible chair of this invention prior to carrying or storing the chair, the two chair units 10 and 10' are easily collapsed at the collapsible intermediate leg frames 3 and 5 provided between the two chair units 10 and 10'.

Figure 8A:
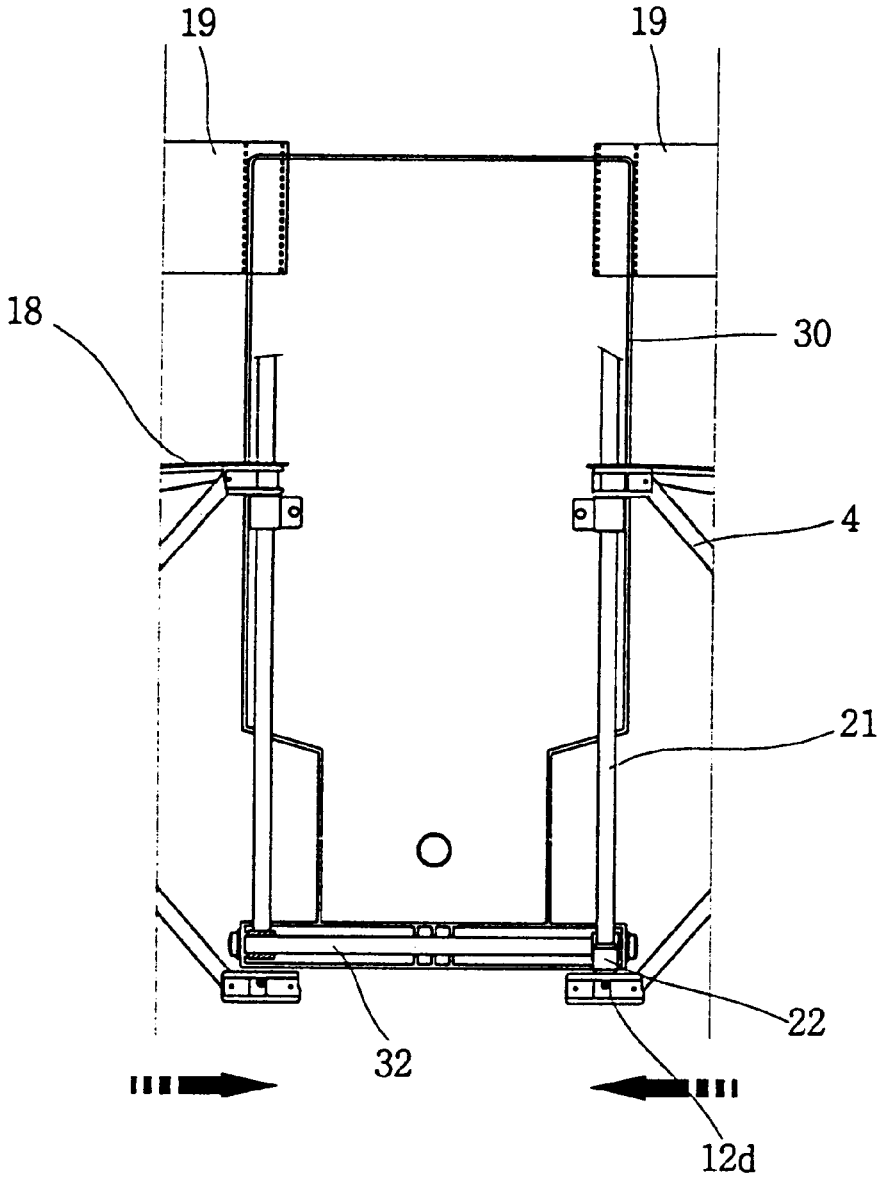
FIGS. 8*a* and 8*b* are front views, showing a slidable movement of two guide members along the horizontal bar of the table when the chair of this invention is fully closed.
Figure 8B:
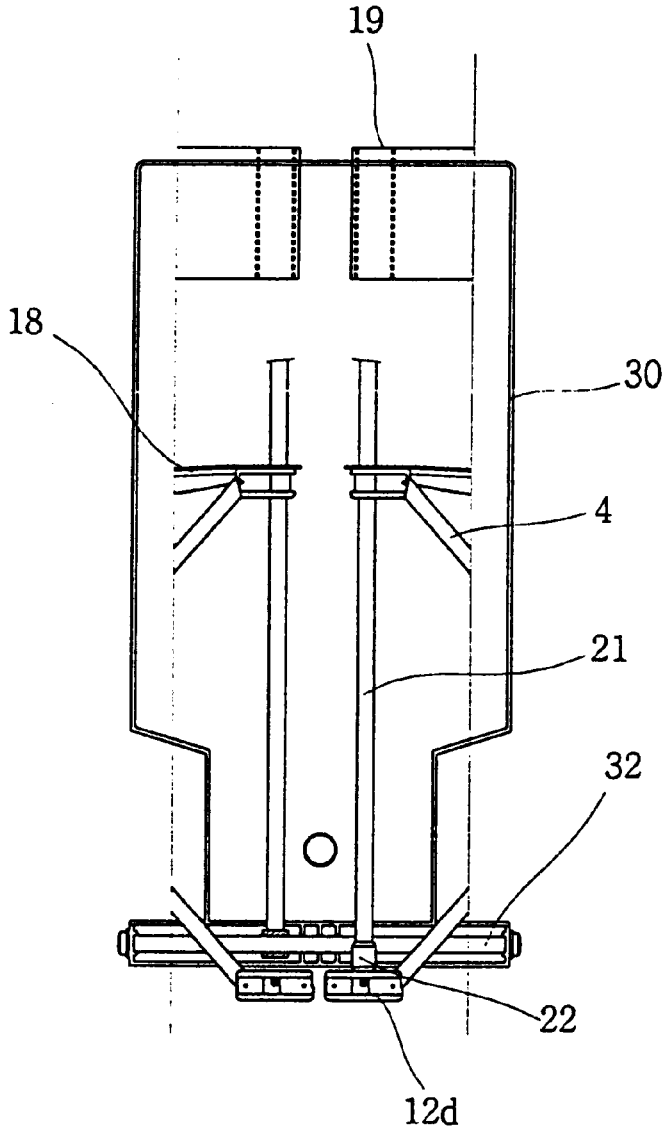
Figure 9:
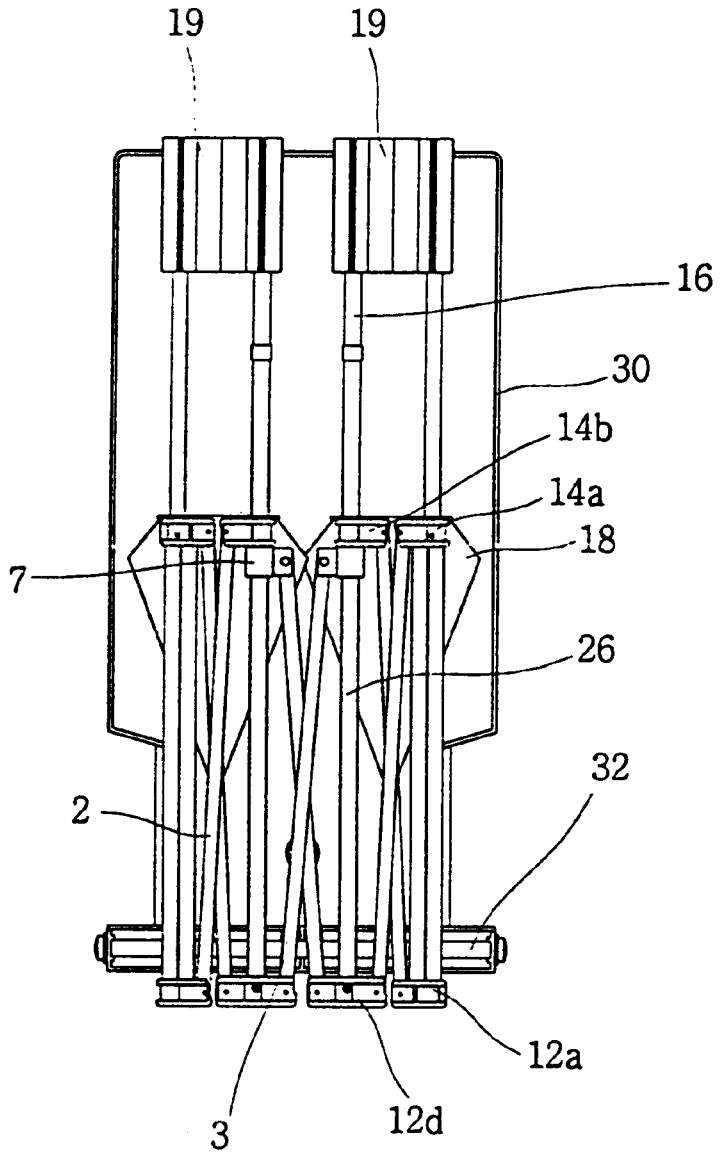
FIG. 9 is a front view, showing the collapsible chair with the table of this invention when the chair and the table are fully collapsed.

When collapsing the chair of this invention, the two guide members 22 of the guide columns 21, provided at the rear portion of the chair, are moved in opposite direction so as to commonly reach the center portion of the horizontal bar 32 of the table 30 as shown in FIG. 8. Therefore, it is possible to reduce the size and volume of the chair when the chair is fully collapsed.

Such a small-sized collapsed chair is convenient to users while carrying, storing or transporting the chair.

As described above, the present invention provides a collapsible chair with a table. The collapsible chair is designed to be selectively used as a chair, a leisure table with chairs, or an indoor simple table with chairs, thereby being conveniently used for a variety of purposes. The collapsible chair of this invention also has a net bag which may be preferably used as a garbage bag or a container capable of receiving food or a variety of necessaries therein when the chair is used outdoors. Due to the net bag, the collapsible chair of this invention is more convenient to users.

The above chair, with the table, is designed to be easily collapsible, thus being convenient to users while carrying or storing it, and requiring only a small area while being used or stored.

Although the preferred embodiments of the present invention have been disclosed for illustrative purposes, those skilled in the art will appreciate that various modifications, additions and substitutions are possible, without departing from the scope and spirit of the invention as disclosed in the accompanying claims. For example, a part of the construction of the two collapsible chair units may be changed without affecting the functioning of this invention. In a detailed description, the structure of the leg frames and the configuration of both the seat member and the back support member may be somewhat freely modified without affecting the functioning of this invention.

What is claimed is:

1. A collapsible chair, comprising:

two or more collapsible chair units arranged abreast on the chair with a gap being defined between the chair units, said collapsible chair units being integrated with each other into a collapsible single body, each of the chair units further comprising front, rear, left and right X-shaped collapsible leg frames, a plurality of front and rear supports, a plurality of front and rear connectors, two back support columns, a back support member, a seat member, a pair of guide columns, a support wire and two auxiliary connectors; said leg frames being coupled to each other at their upper and lower ends using said plurality of front and rear supports and said plurality of front and rear connectors, thus forming a collapsible chair framework with two back support columns being held by the two rear supports and the two rear connectors, said two back support columns supporting said back support member, each of the collapsible chair units also having said seat member supported by the front and rear connectors which respectively define the front and rear portions of the chair;

said guide columns being oriented vertically and being positioned in the back of the inside one of the two back support columns of each collapsible chair unit while extending in parallel to the back support column, each said guide column being fixed to the inside one of rear supports of adjacent chair units, with the collapsible chair units additionally being coupled to each other into the collapsible single body by the support wire, which is attached across the chair unit tops such as to encircle the tops of the two auxiliary connectors, which are vertically oriented and individually mounted to the top portion of both the inside back support column and an associated vertical guide column of each of the collapsible chair units;

a movable guide member received in each of the guide columns in a way such that the guide member is movable in a vertical direction under the guidance of said guide column, with a table being movably coupled to the outside end of the guide members of adjacent collapsible chair units in a way such that the table is rotatable around the two guide members forwardly or backwardly;

two front vertical columns individually provided at the inside corner of the front portion of each collapsible chair unit, thus supporting the front portion of said table when the table is positioned horizontally; and an extension provided at each of the two auxiliary connectors so as to allow the two auxiliary connectors to have the same height as that of the two front vertical columns, thus supporting the rear portion of said table when the table is positioned horizontally.

2. The collapsible chair according to claim 1, wherein said table has a horizontal bar, with both ends of the horizontal bar meeting said two guide columns at right angles, said horizontal bar being brought into slidable engagement with the two guide members in a way such that the guide members are movable in opposite directions along the horizontal bar when the collapsible chair is opened or closed, said table also being rotatable around the two guide members forwardly and backwardly.

3. The collapsible chair according to claim 1, wherein an elastic support wire is horizontally provided on the rear edge of said table, said support wire being locked to a locking hole formed at each of the two auxiliary connectors when the table is fully collapsed into a vertical closed position, said support wire thus holding the table in said vertical closed position without allowing the table to be movable.

4. The collapsible chair according to claim 1, wherein each front vertical column has a top end and a locking cap which is fitted over the top end of each of said two front vertical columns, with a locking slot being formed at each side edge of the table at a position corresponding to each of the locking caps, said locking caps thus being fitted into the locking slots of the table and stably supporting the front portion of the table when the table is horizontally positioned at the gap between the collapsible chair units.

5. The collapsible chair according to claim 1, wherein a net bag, opened at its top, is removably provided at the gap between the collapsible chair units, said net bag having four hook rings at four corners of its top edge and being removably attached to both the two front vertical columns and the two inside back support columns at the four hook rings.

* * * * *